US008135862B2

(12) United States Patent
Singh et al.

(10) Patent No.: US 8,135,862 B2
(45) **Date of Patent: *Mar. 13, 2012**

(54) REAL-TIME, BI-DIRECTIONAL DATA MANAGEMENT

(75) Inventors: Vivek Singh, Houston, TX (US); Bruce Fogelsong, Sugar Land, TX (US); Sam Marcuccio, Friendswood, TX (US); Clinton Chapman, Missouri City, TX (US); Paul Thow, Spring, TX (US); Jim Brannigan, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 426 days.

This patent is subject to a terminal disclaimer.

(21) Appl. No.: 12/349,684

(22) Filed: Jan. 7, 2009

(65) Prior Publication Data

US 2009/0182472 A1 Jul. 16, 2009

Related U.S. Application Data

(60) Provisional application No. 61/020,975, filed on Jan. 14, 2008.

(51) Int. Cl.
*G06F 15/16* (2006.01)

(52) U.S. Cl. ..... 709/246; 709/230

(58) Field of Classification Search ..... 709/246
See application file for complete search history.

(56) References Cited

U.S. PATENT DOCUMENTS 5,139,094 A 8/1992 Prevedel et al.
5,375,098 A * 12/1994 Malone et al. ..... 367/83
5,680,906 A 10/1997 Andrieux et al.
5,899,958 A 5/1999 Dowell et al.
6,266,619 B1 7/2001 Thomas et al.
6,519,568 B1 2/2003 Harvey et al.
6,760,665 B1 * 7/2004 Francis ..... 702/6
7,003,439 B2 2/2006 Aldred et al.
7,079,952 B2 7/2006 Thomas et al.
7,765,254 B2 * 7/2010 Hariharan et al. ..... 709/201
2004/0050590 A1 3/2004 Pirovolou et al.
2004/0231851 A1 11/2004 Silvers
2005/0189142 A1 9/2005 Garcia et al.
2005/0194182 A1 * 9/2005 Rodney et al. ..... 175/24
2005/0209836 A1 9/2005 Klumpen et al.
2005/0211468 A1 9/2005 Veeningen et al.
2005/0228905 A1 10/2005 Veeningen et al.
2005/0236184 A1 10/2005 Veeningen et al.
2006/0290528 A1 12/2006 MacPherson et al.
2007/0047279 A1 * 3/2007 Evans et al. ..... 365/1

* cited by examiner

*Primary Examiner* — Christopher Biagini

(57) ABSTRACT

An example method for real-time bi-directional data management includes receiving a requested data list from a field application, receiving an available data list from a data source, and subscribing to available data by mapping the available data list to the requested data list, the available data having a first data format and a first protocol and including a first context identifier for identifying a portion of data. The method further includes modifying the available data have a second data format and a second protocol, the modified data including the first context identifier, and performing a field operation based on the modified data to generate processed data, the processed data including the first context identifier. The method further includes modifying the processed data to generate second modified data having the first data format and the first protocol, the second modified data being stored in the data source.

19 Claims, 7 Drawing Sheets

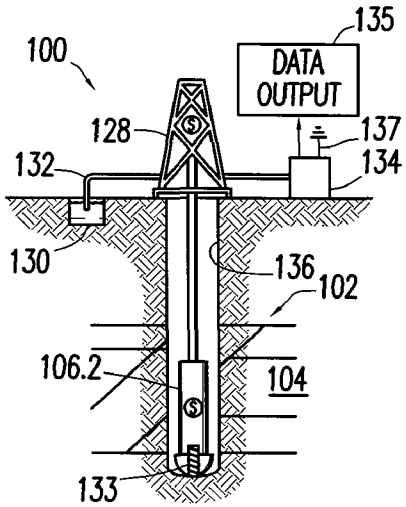
FIG. 1.1
FIG. 1.2
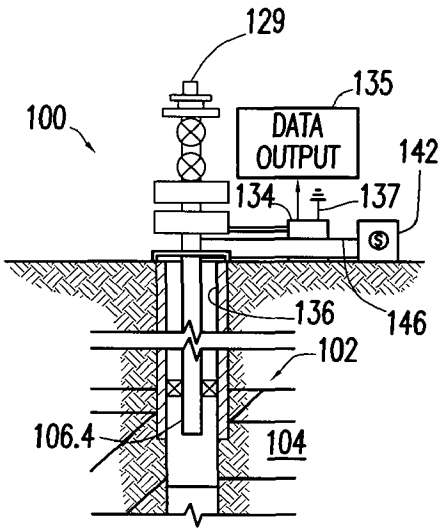
FIG. 1.4
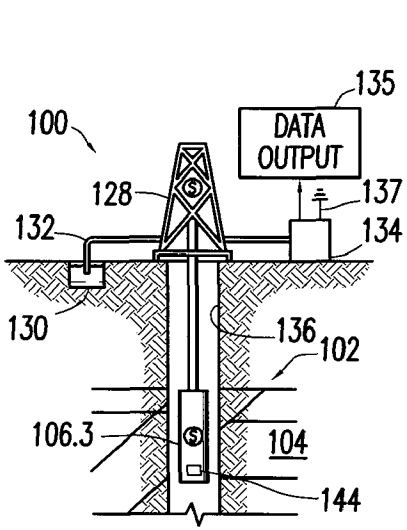
FIG. 1.3

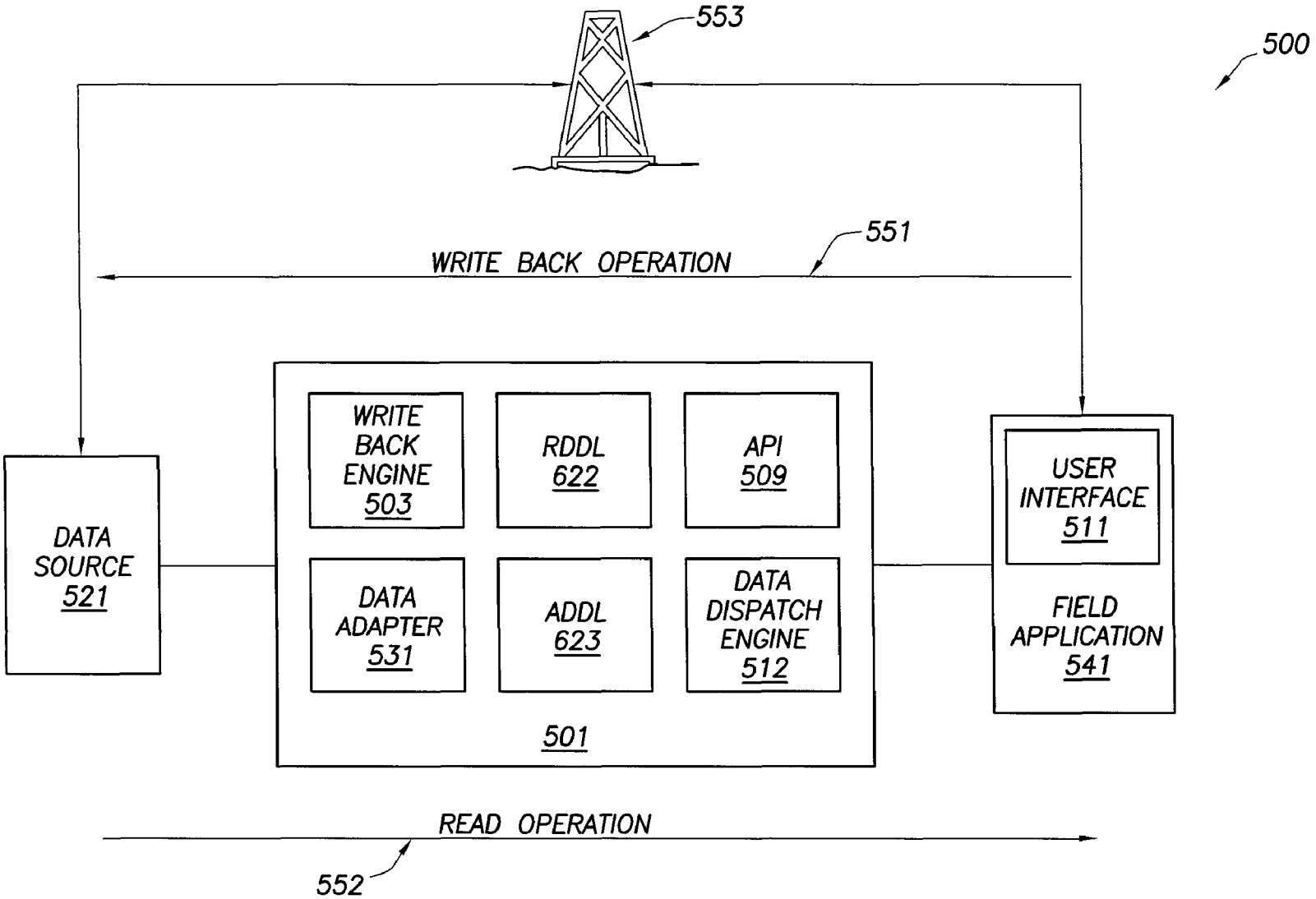
FIG.3.1

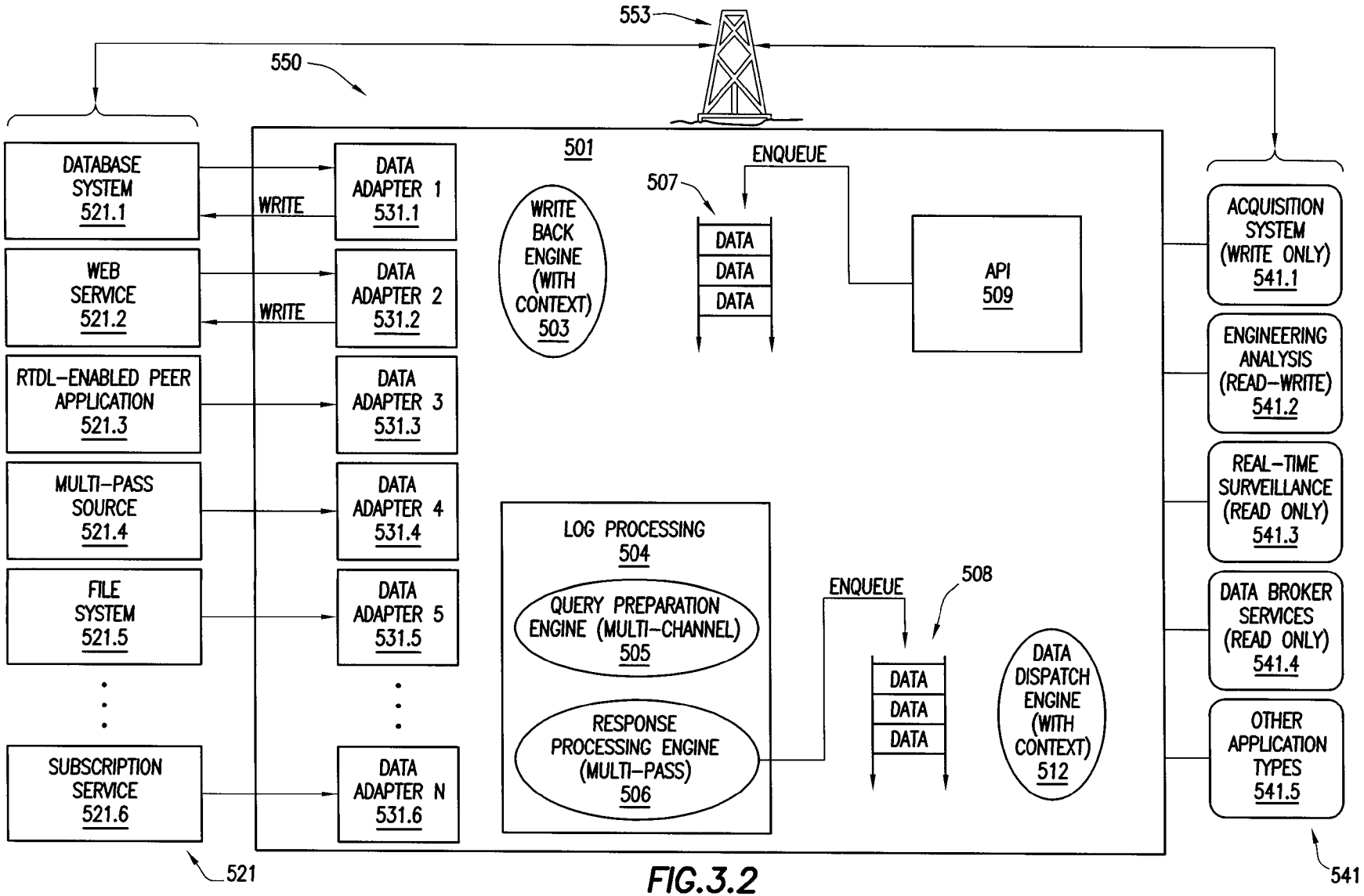
FIG.3.2

REAL-TIME, BI-DIRECTIONAL DATA MANAGEMENT

CROSS REFERENCE TO RELATED APPLICATIONS

This application claims priority, pursuant to 35 U.S.C. §119(e), to the filing date of U.S. Patent Application Ser. No. 61/020,975, entitled "Method and System for Field Drilling Operations," filed on Jan. 14, 2008, which is hereby incorporated by reference in its entirety.

This application contains subject matter that may be related to U.S. application Ser. No. 11/215,605, Francine Evans, et al., "Middleware method and apparatus and program storage device adapted for linking data sources to software applications," filed Aug. 30, 2005 and assigned to Schlumberger Technology Corporation.

BACKGROUND

Operations, such as surveying, drilling, wireline testing, completions, production, planning and field analysis, are typically performed to locate and gather valuable downhole fluids. Surveys are often performed using acquisition methodologies, such as seismic scanners or surveyors to generate maps of underground formations. These formations are often analyzed to determine the presence of subterranean assets, such as valuable fluids or minerals, or to determine if the formations have characteristics suitable for storing fluids.

During drilling and production operations, data is typically collected for analysis and/or monitoring of the operations. Such data may include, for example, information regarding subterranean formations, equipment, and historical and/or other data.

Data concerning the subterranean formation is collected using a variety of sources. Such formation data may be static or dynamic. Static data relates to, for example, formation structure and geological stratigraphy that define geological structures of the subterranean formation. Dynamic data relates to, for example, fluids flowing through the geologic structures of the subterranean formation over time. Such static and/or dynamic data may be collected to learn more about the formations and the valuable assets contained therein.

SUMMARY

An example method for real-time bi-directional data management includes receiving a requested data description list from a field application associated with a drilling system, receiving an available data description list from a data source, and subscribing to available data by mapping the available data description list to the requested data description list, the available data having a first data format and a first communication protocol associated with the data source and including a first context identifier assigned by the data source for identifying a portion of the available data. The method further includes modifying the available data to generate first modified data having a second data format and a second communication protocol for sending to the field application, the first modified data including the first context identifier for identifying a portion of the first modified data, and selectively performing a field operation based on the first modified data to generate processed data by the field application, the processed data including the first context identifier for identifying a portion of the processed data. The method further includes modifying the processed data to generate second modified data having the first data format and the first communication protocol, the second modified data being stored in the data source.

Other aspects of the inventive concept will be apparent from the following description and the appended claims.

BRIEF DESCRIPTION OF DRAWINGS

So that the above described features of real-time, bi-directional data management can be understood in detail, a more particular description of real-time, bi-directional data management, briefly summarized above, may be had by reference to the embodiments thereof that are illustrated in the appended drawings. It is to be noted, however, that the appended drawings illustrate only typical embodiments and are therefore not to be considered limiting of its scope, for real-time, bi-directional data management may admit to other equally effective embodiments.

FIGS. 1.1-1.4 depict a schematic view of a field having subterranean structures containing reservoirs therein, various operations being performed on the field.

FIG. 3.1 shows a schematic diagram depicting a framework for supporting real-time data workflows of a drilling operation.

FIG. 3.2 shows a schematic diagram depicting a real-time data workflow of a drilling operation.

DETAILED DESCRIPTION

Figure 2:
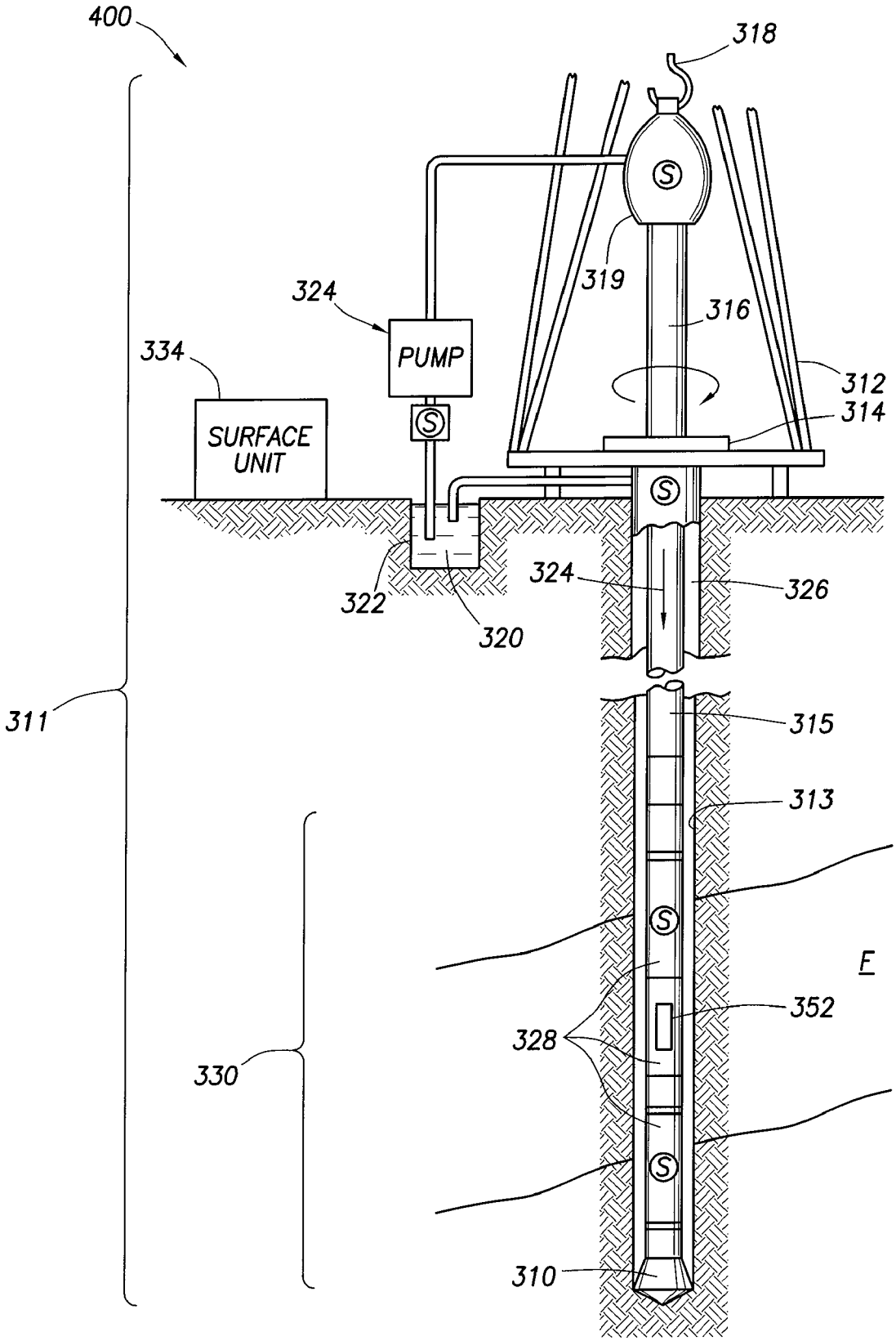
FIG. 2 depicts a schematic view, partially in cross-section of a drilling operation of a wellsite.

Specific embodiments will now be described in detail with reference to the accompanying figures. Like elements in the various figures are denoted by like reference numerals for consistency.

In the following detailed description, numerous specific details are set forth in order to provide a more thorough understanding. In other instances, well-known features have not been described in detail to avoid obscuring embodiments of real-time, bi-directional data management.

In general, embodiments of real-time, bi-directional data management provide a method and system for obtaining field data. More specifically, use of real-time, bi-directional data management, in part, includes read operations and write-back operations for a wide variety of field applications (e.g., acquisition system, engineering analysis, real-time surveillance, data broker service, and other oilfield applications) based on a wide variety of data sources for field operations, such as database system, file system, web service, peer application, multi-pass source, subscription service, and other data sources. In some embodiments, real-time data workflows of field data consider context information (e.g. wellbore name, drilling tool run number, etc.) throughout a read operation followed by a write-back operation with modification of data in the intervening field application.

Furthermore, in some embodiments of the invention, real-time data workflows are capable of requesting multiple data channels in a single operation and processing data logs from multiple drilling tool runs and associated drilling tool passes. In addition, the exchange of field data may be performance-optimized to reduce data transfers and also to manage the system load of both data sources and field applications. The real-time data workflows may be capable of, but not limited to, one of more of the following: efficient transparent write-back, multi-homed write-back, write-back cache persistency, publishing data back to the data source, efficient reading of multiple channels of data concurrently, providing access to data from multiple operations, providing context information to the application and reflecting the application context within the user-interface, providing detailed context information back to the application, transforming queries and responses based upon a selected source without the need for a new adapter, applying the transformations in a configurable pipeline effecting template reuse and modularization, specifying a global start and end point to govern the data flow, etc.

FIGS. 1.1-1.4 depict simplified, representative, schematic views of a field (100) having subterranean formation (102) containing reservoir (104) therein and depicting various field operations being performed on the field (100). FIG. 1.1 depicts a survey operation being performed by a survey tool, such as seismic truck (106.1) to measure properties of the subterranean formation. The survey operation is a seismic survey operation for producing sound vibrations (112). In FIG. 1.1, one such sound vibration (112) generated by a source (110) and reflects off a plurality of horizons (114) in an earth formation (116). The sound vibration(s) (112) is (are) received in by sensors (S), such as geophone-receivers (118), situated on the earth's surface, and the geophone-receivers (118) produce electrical output signals, referred to as data received (120) in FIG. 1. The data received (120) is provided as input data to a computer (122*a*) of the seismic truck (106.1), and responsive to the input data, the computer (122*a*) generates a seismic data output record (124).

FIG. 1.2 depicts a drilling operation being performed by drilling tools (106.2) suspended by a rig (128) and advanced into the subterranean formations (102) to form a wellbore (136). A mud pit (130) is used to draw drilling mud into the drilling tools (106.2) via flow line (132) for circulating drilling mud through the drilling tools (106.2), up the wellbore and back to the surface. The drilling tools (106.2) are advanced into the subterranean formations to reach reservoir (104). Each well may target one or more reservoirs. The drilling tools (106.2) are adapted for measuring downhole properties using logging while frilling tools. The logging while drilling tool (106.2) may also be adapted for taking a core sample (133) as shown, or removed so that a core sample (133) may be taken using another tool.

A surface unit (134) is used to communicate with the drilling tools (106.2) and/or offsite operations. The surface unit (134) is capable of communicating with the drilling tools (106.2) to send commands to the drilling tools, and to receive data therefrom. The surface unit (134) collects data generated during the drilling operation and produces data output (135) which may be stored or transmitted. Computer facilities, may be positioned at various locations about the field (100) (e.g., the surface unit (134)) and/or at remote locations.

Sensors (S), such as gauges, may be positioned about the field to collect data relating to various field operations. As shown, the sensor (S) is positioned in one or more locations in the drilling tools and/or at the rig to measure drilling parameters, such as weight on bit, torque on bit, pressures, temperatures, flow rates, compositions, rotary speed and/or other parameters of the field operation. Sensor may also be positioned in one or more locations in the circulating system.

The data gathered by the sensors (S) may be collected by the surface unit (134) and/or other data collection sources for analysis or other processing. The data may be historical data, real time data or combinations thereof. The real time data may be used in real time, or stored for later use. The data may also be combined with historical data or other inputs for further analysis. The data may be stored in separate databases, or combined into a single database.

Data outputs from the various sensors (S) positioned about the field (100) may be processed for use. The data may be historical data, real time data, or combinations thereof. The real time data may be used in real time, or stored for later use. The data may also be combined with historical data or other inputs for further analysis. The data may be housed in separate databases, or combined into a single database.

FIG. 1.3 depicts a wireline operation being performed by a wireline tool (106.3) suspended by the rig (128) and into the wellbore (136) of FIG. 1.2. The wireline tool (106.3) is adapted for deployment into a wellbore (136) for generating well logs, performing downhole tests and/or collecting samples. The wireline tool (106.3) may be used to provide another method and apparatus for performing a seismic survey operation. The wireline tool (106.3) of FIG. 1.3 may, for instance, have an explosive, radioactive, electrical, or acoustic energy source (144) that sends and/or receives electrical signals to the surrounding subterranean formations (102) and fluids therein.

Sensors (S), such as gauges, may be positioned about the field (100) to collect data relating to various field operations as described previously. As shown, the sensor S is positioned in the wireline tool to measure downhole parameters, which relate to, for instance porosity, permeability, fluid composition and/or other parameters of the field operation.

FIG. 1.4 depicts a production operation being performed by a production tool (106.4) deployed from a production unit or Christmas tree (129) and into the completed wellbore (136) of FIG.1.3 for drawing fluid from the downhole reservoirs into the surface facilities (142). Fluid flows from reservoir (104) through perforations in the casing (not shown) and into the production tool (106.4) in the wellbore (136) and to the surface facilities (142) via a gathering network (146).

Sensors (S), such as gauges, may be positioned about the field (100) to collect data relating to various field operations as described previously. As shown, the sensor (S) may be positioned in the production tool (106.4) or associated equipment, such as the Christmas tree (129), gathering network (146), surface facilities (142) and/or the production facility, to measure fluid parameters, such as fluid composition, flow rates, pressures, temperatures, and/or other parameters of the production operation.

While only simplified wellsite configurations are shown, it will be appreciated that the field may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite(s).

While FIGS. 1.2-1.4 depict tools used to measure properties of a field (100), it will be appreciated that the tools may be used in connection with non-wellsite operations, such as mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The field configuration in FIGS. 1.1-1.4 is intended to provide a brief description of an example of a field usable with real-time data workflows. Part, or all, of the field (100) may be on land and/or sea. Also, while a single field measured at a single location is depicted, real-time data workflows may be utilized with any combination of one or more fields (100), one or more processing facilities and one or more wellsites.

FIG. 2 depicts a schematic view, partially in cross-section of a drilling operation, such as the drilling operation of FIG. 1.2, of a field in detail. The wellsite system (400) includes a drilling system (311) and a surface unit (334). In the illustrated embodiment, a borehole (313) is formed by rotary drilling in a manner that is well known. Those of ordinary skill in the art given the benefit of this disclosure will appreciate, however, that real-time data workflows also find application in drilling applications other than conventional rotary drilling (e.g., mud-motor based directional drilling), and is not limited to land-based rigs.

The drilling system (311) includes a drill string (315) suspended within the borehole (313) with a drill bit (310) at its lower end. The drilling system (311) also includes the land-based platform and derrick assembly (312) positioned over the borehole (313) penetrating a subsurface formation (F). The assembly (312) includes a rotary table (314), kelly (316), hook (318) and rotary swivel (319). The drill string (315) is rotated by the rotary table (314), energized by means not shown, which engages the kelly (316) at the upper end of the drill string. The drill string (315) is suspended from hook (318), attached to a traveling block (also not shown), through the kelly (316) and a rotary swivel (319) which permits rotation of the drill string relative to the hook.

The drilling system (311) further includes drilling fluid or mud (320) stored in a pit (322) formed at the well site. A pump (324) delivers the drilling fluid (320) to the interior of the drill string (315) via a port in the swivel (319), inducing the drilling fluid to flow downwardly through the drill string (315) as indicated by the directional arrow (324). The drilling fluid exits the drill string (315) via ports in the drill bit (310), and then circulates upwardly through the region between the outside of the drill string and the wall of the borehole, called the annulus (326). In this manner, the drilling fluid lubricates the drill bit (310) and carries formation cuttings up to the surface as it is returned to the pit (322) for recirculation.

The drill string (315) further includes a bottom hole assembly (BHA), generally referred to as (330), near the drill bit (310) (in other words, within several drill collar lengths from the drill bit). The bottom hole assembly (330) includes capabilities for measuring, processing, and storing information, as well as communicating with the surface unit. The BHA (330) further includes drill collars (328) for performing various other measurement functions.

Sensors (S) are located about the wellsite to collect data, in real time, concerning the operation of the wellsite, as well as conditions at the wellsite. The sensors (S) of FIG. 2 may be the same as the sensors of FIGS. 1.1-1.4.

The drilling system (310) is operatively connected to the surface unit (334) for communication therewith. The BHA (330) is provided with a communication subassembly (352) that communicates with the surface unit. The communication subassembly (352) is adapted to send signals to and receive signals from the surface using mud pulse telemetry. It will be appreciated by one of skill in the art that a variety of telemetry systems may be employed, such as wired drill pipe, electromagnetic or other known telemetry systems.

Typically, the wellbore is drilled according to a drilling plan that is established prior to drilling. The drilling plan typically sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also need adjustment as new information is collected.

FIG. 3.1 shows a schematic diagram depicting a framework (500) for supporting real-time data workflows of a drilling operation of a field. As shown in FIG. 3.1, the real-time data workflows includes read operation (552) and write-back operation (551). The framework (500) includes a middleware apparatus (501) and associated methods and program storage devices (and/or storage repositories) adapted for interfacing between one or more data sources (521) and one or more field applications (541) (or other software applications). The one or more data sources (521) and one or more field applications (541) (or other software applications) receive information in the form of data from various sources including a field (553).

The middleware apparatus (501) is capable of supporting real-time data workflows and may be referred to as a Real-Time Data Link (RTDL) in some examples. A field application (541) may be configured to operate cooperatively with the RTDL (501) and referred to as RTDL-enabled software application (also referred to herein as RTDL-enabled application). Based on the functionality of the RTDL (501), each software application (541) may include a graphical user interface (i.e., GUI) (511) to obtain data from any data source (521) without the need to be configured specifically for the data formats and the communication protocols associated with the received data. The graphical user interface (511) may be displayed to a user by the RTDL-enabled field application (541).

Further, as shown in FIG. 3.1, the RTDL (501) includes application programming interface (API) (509), data adapters (531), requested data description list (RDDL) (522), available data description list (ADDL) (523), write-back engine (503), and data dispatch engine (512).

The API (509) may include public methods of RTDL (501), which the field applications (541) may call. These public methods of API (509) abstract many differences between the real-time data sources (521) and provides the field applications (541) with a consistent way of consuming source data, which may be implemented in the graphical user interface (511). From a user interaction perspective, one or more of the data sources (521) may be selected via the graphical user interface (511) available via one of the field applications (541), and then the user is guided through a series of data source-specific interactions that result in the selected data being asynchronously transferred to the application. In this process, the data adapters (531) handle all the communication with the data sources (521) thus hiding the differences in the communication protocols from the field applications (541). Multiple data sources may be interfaced within an adapter. Most data sources may be live and supplying real-time data to the RTDL (501), but the RTDL (501) may also be configured with the capability to process local drilling files having historical data. In the case of live data sources, the RTDL (501) may be further configured to optimize interactions with the data sources (521) in order to reduce data transfers and to reduce the system load of both the data sources (521) and the field applications (541).

In one or more embodiments, the RTDL (501) optimizes interactions with the data sources (541) by accommodating for lagging channels (i.e., sparsely available field data). For instance, lagging channels may occur, but not limited to, when querying multiple data channels sharing a common index and at least one of the data channels does not span the entire index range, when data gaps exist for certain data channels while others are real-time data, or when a late available data description selection by the user occurs during a mature real-time session. In this instance, the lagging channels may result in query responses including superfluous data that has been previously processed in the session, causing the RTDL (501) to fall behind real-time because data sources (541) may limit the amount of data returned in each query. The RTDL (501) may be configured to accommodate the lagging channels by performing continuous pre-query analysis of the requested data channels and sub-dividing the data channels into independent query groups, which are sent as separate requests. In this case, the query group associated with the lagging channels may rejoin the real-time query group once the lagging channels achieve real-time.

In one or more embodiments, the RTDL (501) optimizes interactions with the data sources (541) based on the status of field data in the data sources (541). Examples of statuses of field data include, but are not limited to, incrementally increasing, temporarily paused, or complete (i.e., no additional field data). The RTDL (501) may initially determine by default that the data of each data source (541) is increasing. The RTDL (501) may be further configured to pre-query a timestamp of the data sources (541) to reduce the occurrence of unnecessary queries for completed field data. For instance, once the field data of a particular data source (541) is complete, the RTDL (501) may determine based on a timestamp from the particular data source (541) that a continuous query of the particular data source (541) is no longer necessary. In this instance, if the field data of the particular data source (541) is subsequently increased, the RTDL (501) is notified based on the timestamp and may resume querying the particular data source (541) normally.

The series of data source-specific interactions described above may be embodied in a variety of workflows. For instance, requested data description list (RDDL) (522) may be supplied by the field application (541) to the RTDL (501). An RDDL is a flexible object that provides a search filter for the RTDL (501) in interrogating one or more data sources (521) regarding available data. RDDL (522) may be with or without wildcards. As a result, search results may be returned from interrogated data sources (521) in the form of available data description list (ADDL) (523). A user of the field applications (541) may then map the RDDL and the ADDL for matching available data to the initial requests. An example of ADDL (523) is described in detail with respect to FIG. 5 below. A feature may also be available to automatically provide RDDL to ADDL mappings, without the necessity of user interaction.

In addition, the RTDL (501) also includes a write-back engine (503) and a data dispatcher (512). The write-back engine (503) is configured to provide the capability to publish data back to the data sources (521). The data dispatcher is configured to provide context information to the application. Also, the API can be employed to reflect the application context within the graphical user interface (511). The RTDL (501) may also be configured with the capabilities to transform queries and responses based upon a selected source, read multiple channels of data concurrently, provide access to data from multiple operations, etc. More details of these capabilities are described with respect to FIGS. 5.2 and 7 below. Field applications and users may use the framework (500) to specify a global start and end point to govern the real-time data workflow.

FIG. 3.2 shows a schematic diagram depicting a real-time data workflow (550) of a drilling operation of a field (553). The real-time data workflow (550) is performed using the RTDL (550), which is essentially the same as the RTDL (501) of FIG. 3.1. The RTDL (550) shown in FIG. 3.2 includes additional detail, for instance, data adapters (531.1)-(531.6), a write-back engine (with context) (503), a write data queue (507), a log processing module (504) having query preparation engine (505) and a response processing engine (506), a read data queue (508), an API (509), and a data dispatch engine (with context) (512)).

As shown in FIG. 3.2, one or more data sources (521) of FIG. 3.1 may include database system (521.1), web service (521.2), RTDL-enabled peer application (521.3), multi-pass source (521.4), file system (521.5), subscription service (521.6), or other field data sources. Each of these real-time data sources (521) may be coupled to a particular data adaptor, such as data adaptors (531.1)-(531.6). For instance, the data adapters may include functionalities for communicating with WITSML (Wellsite Information Transfer Standard Markup Language) API Servers, communicating with a Drilling Acquisition Systems, consuming real-time drilling files published on a server, consuming files recorded by a RTDL recorder tool (e.g., testing and simulation tool), etc. Although not shown in FIG. 3.2, each adaptor type may be associated with a set of one or more data sources (521). Each data source(s) (521) may be represented by an XML configuration, which includes references to the various adaptor methods. In some instances, a sub-class may be derived from an adaptor to provide special behavior required by a data source. For instance, source-specific behavioral differentiation may be reflected in XSL (extensible style-sheet language) transforms of the request and response messages for the WITSML API Servers.

The data adapters (531) described above may be configured to transform data from one or more data sources (521) based on the requirements of a field application (541). In this case, the data adapters (531) may use transformation scripts to transform the data from the data sources (521). Further, the transformation scripts may be modularized such that common transformations may be shared between multiple data adapters (531) and data sources (521) (i.e., a transformation pipeline). For instance, multiple data sources (521) may include similar types of data; thus, the corresponding data adapters (531) may require a common transformation for at least a portion of the similar types of data. In this instance, each data adapter (531) may also use additional transformations that are specific to other data sources (521) associated with the data adapter (531). Those skilled in the art will appreciate that the modularization of transformation scripts facilitates the combination of reusable, vendor-neutral transformation scripts and vendor-specific transformation scripts.

In addition, the field applications (541) (as also shown in FIG. 3.1) may include acquisition system (541.1), engineering analysis (541.2), real-time surveillance (541.3), data broker services (541.4), or other application types (541.5). The acquisition system (541.1) may be "write only" in the sense that it only performs the write-back operation (551 in FIG. 3.1) without any read operation (552 in FIG. 3.1). The real-time surveillance (541.3) and data broker services may be read only in the sense that it only performs read operation (552 in FIG. 3.1) without any write-back operation (551 in FIG. 3.1) The engineering analysis (541.2) may be may be read-write capable in the sense that read data from one of the data source(s) (521) may be modified, adjusted, or otherwise processed by the engineering analysis (541.2) and written back to the data source(s) (521) subsequently. In some examples, the field application may be multi-homed in the sense that it may be reading from one data source while writing back to another data source. A field application may connect simultaneously to two or more RTDL instances each associated with a different data source. The first RTDL instance may be used for reading data while the second RTDL instance may be used for writing back data. Multi-homed field application may be used in, for instance providing correlation between different wells, or assimilating disparate data from multiple data sources.

One or more of the data sources (521.1)-(521.6) may provide many different types of data such as data log, trajectory, risk, message, wellbore geometry (wbGeometry), tubular, operations report (opsReport), etc. Each data type may be formatted differently. For instance, data log may be formatted as a trace chart, a spread-sheet like table, or other appropriate formats. In this instance, a well log may represent resistivity or other measurements taken by a wireline tool at various depths as a depth indexed trace chart. A data log may also be time indexed containing, for instance, hookload measurements at various time points. Furthermore, a data log may include data from multiple data channels corresponding to multiple sensors of a data source. For instance, a data log with a table format may include multiple columns of data channels and multiple rows of data taken at different depth or time. Each point entry relating to a particular data channel at a particular depth or time is referred to as a data point. A single row of data points containing data relating to multiple data channels taken at a common index value is referred to as a vector of data points, or a 'pseudo data frame'. Data depicted in the data queues (507) and (508) may represent data points or vectors of data points. The data queues (507) and (508) may also contain more complex data structures, such as trajectory station or risk data.

In addition, data may be tagged with context information. Context information may include attributes for identifying a data source such as well name (WellName), well ID (WellID), wellbore name (WellboreName), wellbore ID (WellboreID), section name (SectionName), subsection name (SubSectionName), etc. Context information may also include attributes for identifying data collection parameters such as log name, log ID, run number, pass number, pass type, etc. Further, detailed information about logs, channels, and the ADDL (623 in FIG. 3.1) may be available via the API (509).

Further as shown in FIG. 3.2, the write-back engine (503) may operate on data from a data queue (507) enqueued through the API (509) from the field application (541.1)-(541.5). The write-back engine (503) may be configured to perform multiple functionalities, which are described below. Within the real-time data workflows (550), the field applications (541.1)-(541.5) may specify the destination (or target) of the write-back operation (551 in FIG. 3.1)), but the context may be late bound. For instance, a write-back call of the API (509) may include a log name and log ID as a target, but the WellName, WellID, WellboreName and WellboreID may be determined and applied after a connection to the data source is made prior to writing, which is the meaning of the term "with context" in FIG. 3.2. The write-back engine (503) may support two possible operations, namely 'add request' for adding new data object on the data source or 'update request' for updating existing data object on the data source. The operations (adding or updating) are transparent to the field applications (541.1)-(541.5). An 'add request' may be sent first, and if this fails because the data object already exists, all future requests may then be converted to 'update requests' by the write-back engine (503).

In one or more embodiments, the write-back engine (503) may be configured to process generic, vendor-neutral write requests for different vendor-specific data sources (521.1)-(521.6). For instance, the write-back engine (503) may handle non-standardized error codes returned from the different data sources (521.1)-(521.6) when a fault occurs. In this instance, the RTDL (501) may employ an error code normalization model to allow the write-back engine (503) to handle faults from different data sources (521.1)-(521.6) in a homogenous manner.

Write-back data may be cached inside RTDL (501) under control of the write-back engine (503) so that the field applications (541.1)-(541.5) may operate using a 'fire and forget' model, i.e. applications may use the Write Back API without waiting to determine whether the operations are immediately successful. Accordingly, field applications (541.1)-(541.5) need not be concerned with managing the connection state of the real-time data workflows. RTDL (501) manages the write-back cache (507) for data buffering during disconnects or until the write-back operations are successfully completed. The data buffering may be performed in memory (not shown) and backed up on disk (not shown). Statistics for numbers of rows and tables in the write-back cache may be made available to the field applications (541.1)-(541.5).

Examples of high level calls associated with a 'RTDL. DataWriter' object of the RTDL (501) are given in TABLE 1 below.

TABLE 1

| |
|---|
| AddLogDataToCache - a DataTable of log objects is passed; AddRtdlDataObjectToCache - an ISurvey or IRisk is passed; and Add WitsmlDocToCache - a complete WITSML document is passed, where Log, Trajectory, Risk, WITSML documents are examples of various data types. The field applications may use a WritableDataTypes property of the RTDL (501) to dynamically investigate which WITSML objects a particular data source may support for writing. |

Unwritten data in the write-back cache is persisted to disk and reloaded when RTDL (501) starts up. This guards against losing data updates caused by a system crash. A configuration property, appUsageMode, may be set to RO (read only), RW (read/write) or WO (write only). This setting may affect the behavior of the RTDL (501) and the graphical user interface. It may be set dynamically, or set in the configuration file of the field applications (541.1)-(541.5). Write-backs may be scheduled relatively quickly, for instance, every 5 seconds.

For instance, use cases of the write-back operation (551) may include:

1. Application writes back indexed log data, trajectories, risks, wbGeometries, tubulars, opsReports, message data or other WITSML object types to a WITSML data source;
2. Application writes back indexed string data to a WITSML data source; and
3. Application writes data to a data source from which it is not reading (e.g., acquisition system (541.1)).

TABLE 2 below includes sample code to illustrate, with details omitted, how an application would use the write-back features supported by the RTDL (501).

TABLE 2

```
// Intial Setup
IDataLink2 rtdl = DataLink2Factory.CreateInstance( );
IDataWriter m_WB = rtdl.DataWriter;
Rtdl.Connect( );
// One time creation of the table to hold the app's data
if (logDataTable == null)
{
    // Create a DataTable to hold the data for 2 log channels to be written
    ArrayList cols = new ArrayList(2);
    DataWriter.LogTableColumnDescriptor currentCol;
    // Create a column for PorePres
    currentCol = new
    DataWriter.LogTableColumnDescriptor("PorePres",typeof(Double),"psi");
    cols.Add(currentCol);
    // Create a column for BhTemp
    currentCol = new
    DataWriter.LogTableColumnDescriptor("BhTemp",typeof(Double),"deg");
    cols.Add(currentCol);
        logDataTable =
    m_WB.CreateLogDataTableForWriting(eWbIndexedDataTypes.LogDepth,
                                      "ft", cols);
}
// This following code would be run every time data is to be written. The example shows
// adding one row, but multiple rows can be added.
DataRow r = m_LogDataTable.NewRow( );
r["index"] = 3012;
r["PorePres"] = 8234.5;
r["BhTemp"] = 247.2;
logDataTable.Rows.Add(r);
// This is the actual call to add the data to the DataWriter's cache, where it is held
// until the Write-back Worker thread can successfully transmit it back to the source
m_WB.AddLogDataToCache(eWbIndexedDataTypes.LogTime, logDataTable,
        "Main Depth Log", "Log-1234");
// After successfully caching the data it may be removed from the app's table
logDataTable.Clear( );
```

Further as shown in FIG. 3.2, the query preparation engine (505) may request data by submitting a query to data sources (521.1)-(521.6). The query may be submitted based on the RDDL (622), which may include requests relating to multiple data channels. A substantial performance increase may be realized by using Multi-Channel Queries (MCQ) for data from data sources, such as a WITSML API server. Instead of requesting a single data channel in a querying a data source, the query preparation engine (505) groups a query for multiple data channels into a single request resulting in a substantially lower number of requests and responses, reducing overall bandwidth, and improving overall performance. In a typical drilling operation, processing depth-indexed MCQ responses may require properly managing offsets and lagging channels while processing time-indexed responses via MCQ is relatively straight-forward. The response processing engine (506) may be configured to consider effects of offset and lagging among multiple data channels with respect to a common index in a data log. The response processing engine (506) may be configured to intelligently, and frequently, decide which data channels to involve in calculating the overall minimum depth index for accommodating 'lagging' data channels without being bound by data channels that are not actively increasing. The response processing engine (506) may also be configured to consider duplicated data from overlaps in prior queries when processing depth-indexed MCQ responses. In this case, a data source (521) may be configured to provide a timestamp indicating when the data source (521) was last updated. The query preparation engine (505) may consult the last update timestamp of data sources (521) to optimize data retrieval. For example, the query preparation engine (505) may specify that only data updated after a specified time should be queried, where the response processing engine (506) may use duplicate data from a prior query if the data has not been updated.

In addition, the response processing engine (506) may be configured to manage lagging channels as a query is performed. For instance, if a lagging channel is detected, the response processing engine (506) may separate the portion of the MCQ related to the lagging channel into a separate query. In this instance, the original query may be completed, providing the requested data to a field application (541) while the separate query associated with the lagging channel is still pending.

The high level algorithm and the detailed algorithm for MCQ are given in TABLE 3 and TABLE 4, respectively.

TABLE 3

| For every data query to the server: |
|---|
| 1. First determine min/max for each channel |
| 2. Compute the starting index for the log data query |
| 3. Query the log via an MCQ using the computed starting index |
| 4. Dispatch new data to the application |

TABLE 4

| For each time RTDL, queries the WITSML API server for new Log data rows, the Qualified List of Mapped Channels is determined to Query for data. |
|---|
| 1. Query the meta data for alls logs to determine the current depth index ranges for each mapped channel in each log |
| a. This is done by specifying a LogCurveInfo element for each mapped channel, especially asking for min and max index. |
| b. The result is an initial Qualified List of mapped channels to query, one list per log |

TABLE 4-continued

| For each time RTDL, queries the WITSML API server for new Log data rows, the Qualified List of Mapped Channels is determined to Query for data. |
|---|
| 2. For each Log |
| a. Filter out non-increasing channels: For each mapped channel in the log, if the max index value has previously been received then drop the channel from the Qualified List, otherwise retain it in the List. |
| b. Process the Qualified List to determine the starting index for the upcoming data query |
| i. The data query's starting index is the "minimum" of the last index processed for all qualifying mapped channels in the log that data was received for in the previous query. [If this is the first query, then all channels are included in the calculation of the starting index]. |
| c. Query the log via an MCQ using the starting index |
| i. An MCQ is just a log query template where multiple LogCurveInfo elements are specified |
| ii. The data is returned in a comma-delimited string of the following format: <index value>, <value1>,<value2>,<value3> |
| iii. If data is missing for any of the channels, say the $2^{nd}$ channel, then one could get the following: 1000, 34.5,, 567.9 (As shown above, the double comma is due to the missing $2^{nd}$ channel. But there could be other nullValue possibilities that must also be ignored, e.g. −999.25. This may be specified in the nullValue attribute in LogCurveInfo.) |
| d. Dispatch new data to the application |
| i. Since there is a shared starting index, it is possible that we have received some previously encountered data for certain channels. |
| ii. Therefore RTDL must examine each value before dispatching in order to avoid a "double dispatch" |

In addition, the algorithm described above may be supplemented with considerations for WITMSL servers that do not keep updated minimum index (minIndex) and/or maximum index (maxIndex) for each data channel. The minIndex may be considered in conjunction with a log Direction attribute. For instance, in a decreasing log the minIndex index may represent a deeper depth, and therefore is greater than the maxIndex.

Further, as shown in FIG. 3.2, the response processing engine (506) processes data received from the data sources (521.1)-(521.6) and enqueues data onto the data queue (508) for sending to the field applications (541.1)-(541.5) via the data dispatch engine (512). More details of the response processing engine (506) and the data dispatch engine (512) are described with respect to FIG. 5 below.

In a typical drilling operation depicted in FIG. 2, the drilling tool (e.g., drill string (315), bottom hole assembly (BHA) (330), drill bit (310), etc. shown in FIG. 2) may traverse the borehole (313 shown in FIG. 2) in multiple drilling tool runs (e.g., BHA Run Number 5 and 6 depicted in TABLE 5 below). Each drilling tool run may include multiple drilling tool passes (e.g., PassNumber P1-P 4 of BHA Run Number 5 and PassNumber P1-P2 of BHA Run Number 6 depicted in TABLE 5 below). Each drilling tool pass may include different types of passes (e.g., RIH, REAM, DRILL, BREAM, STRIP, POOH, etc. as described in TABLE 5 below).

TABLE 5

| BHA Run Number | PassNumber | PassType |
|---|---|---|
| 5 | P1 | RIH (Run In Hole) |
| | P1 | REAM (Ream Down) |
| | P1 | DRILL (Drilling) |
| | P2 | BREAM (Back Ream) |
| | P2 | STRIP (Short Trip) |
| | P3 | STRIP (Short Trip) |
| | P3 | REAM (Ream Down) |
| | P3 | DRILL (Drilling) |
| | P4 | POOH (Pull Out of Hole) |
| 6 | P1 | RIH (Run In Hole) |
| | P1 | DRILL (Drilling) |
| | P2 | POOH (Pull Out of Hole) |

Figure 4:
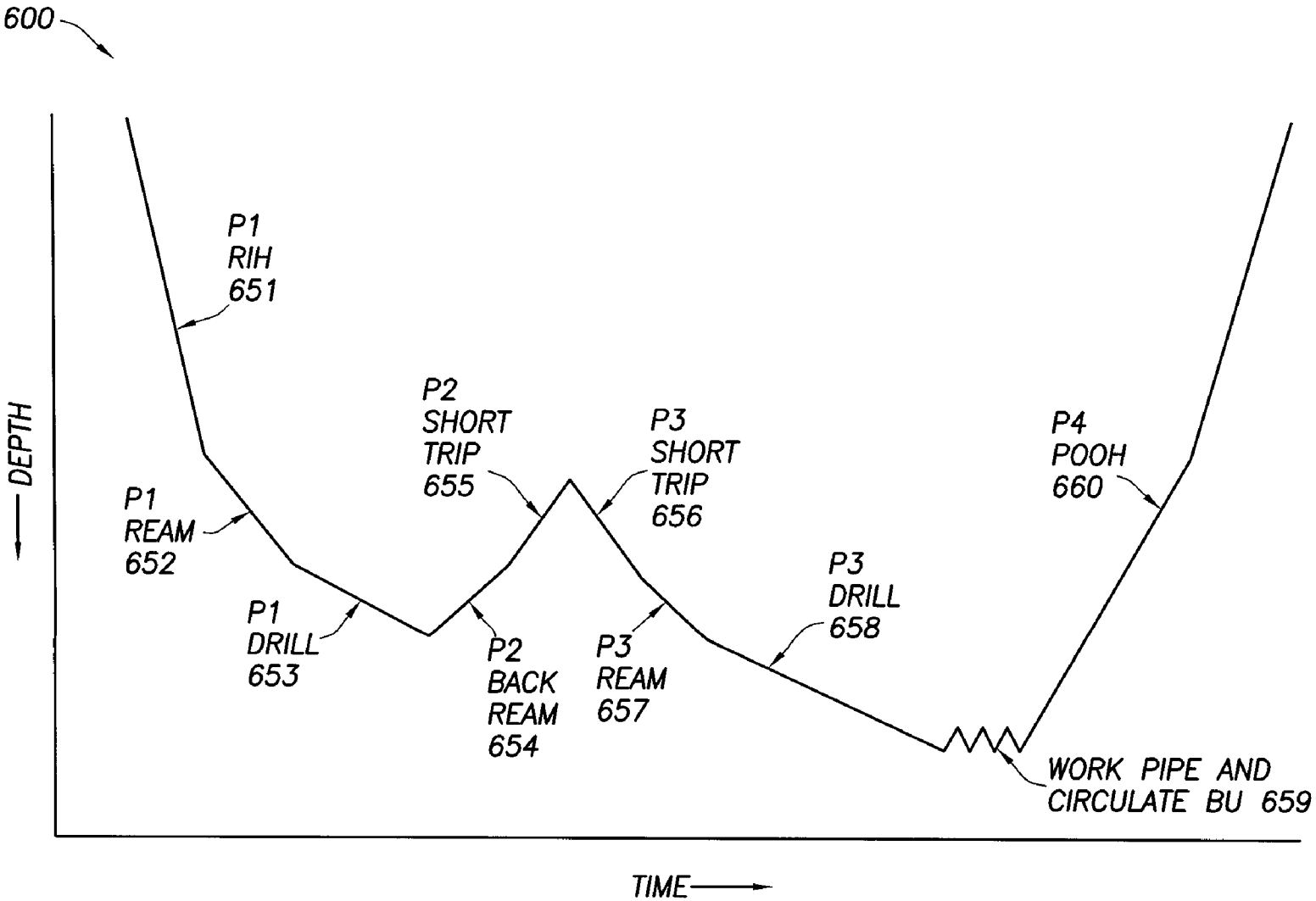
FIG. 4 shows a depth chart depicting multiple drilling tool passes in a drilling tool run of a drilling operation.

FIG. 4 shows a depth chart depicting multiple drilling tool passes in a drilling tool run. As shown in FIG. 4, the vertical axis represents the depth location of the drilling tool and the horizontal axis represents time in the drilling operation. The depth chart includes drilling tool passes P1 RIH (651), P1 REAM (652), P1 Drilling (653), P2 BREAM (654), P2 STRIP (655), P3 STRIP (656), P3 REAM (657), P3 Drilling (658), P4 POOH (660), and a circulation period (659). Data logs (e.g., depth indexed or time indexed data logs) may be generated in each of these drilling tool passes and be tagged with context information referring to the particulars of each drilling tool passes.

Figure 5:
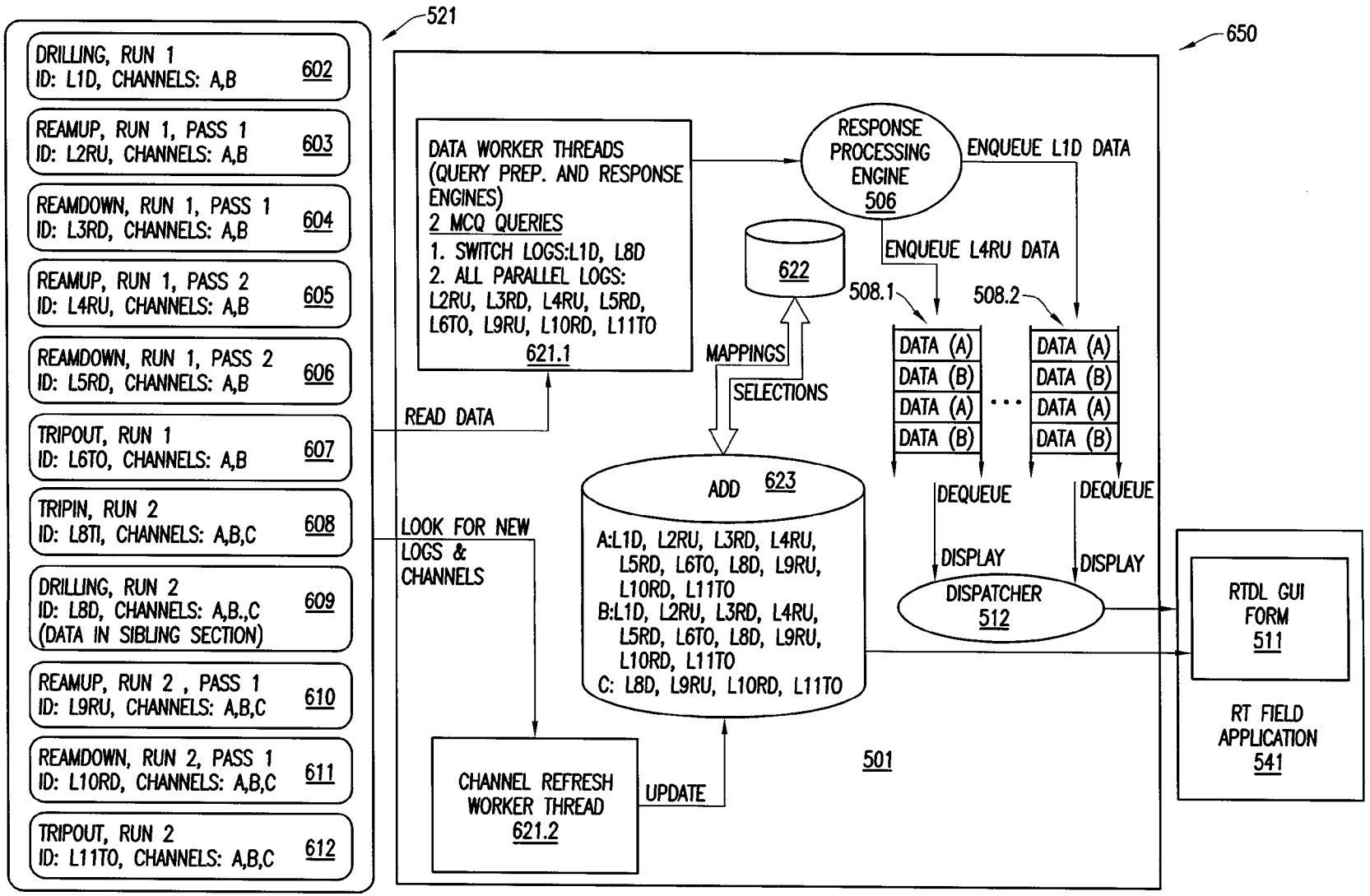
FIG. 5 shows a schematic diagram depicting a real-time data workflow of a drilling operation.

FIG. 5 shows a schematic diagram depicting a real-time data workflow (650) of a field drilling operation. As shown in FIG. 5, the real-time data workflow (650) includes data source(s) (521), RTDL (501), and real-time (RT) field application (541), which are essentially the same as those depicted in FIG. 3.1. The real-time data workflow (650) of FIG. 5 may include more real-time data workflow details.

A drilling operation may include multiple operation stages (e.g., drilling tool runs or passes). Data relates to each operation stage may be stored and dispatched separately. As shown in FIG. 5, the data source(s) (521) depicts a multi-pass data source having data logs (e.g., logged runs (602)-(612)) collected from two BHA runs ('Run 1' and 'Run2') of a drilling operation. Each of the BHA runs may include multiple drilling passes such as 'Drilling', 'ReamUp', 'ReamDown', 'TripIn', 'TripOut', etc. For instance, the data logs (602)-(612) may be collected from the sequence depicted in TABLE 6 below. In these multiple BHA runs, passes that repeat multiple times in a single run may be identified by unique pass numbers.

TABLE 6

| | |
|---|---|
| 1. | Start of "Run 1" |
| 2. | Drilling |
| 3. | Ream Up, pass 1 |
| 4. | Ream Down, pass 1 |
| 5. | Ream Up, pass 2 |
| 6. | Ream Down, pass 2 |
| 7. | Drilling |
| 8. | Trip Out |
| 9. | End of "Run 1" |
| 10. | Start of "Run 2" |
| 11. | Trip In |
| 12. | Drilling |
| 13. | Ream Up, pass 1 |
| 14. | Ream Down, pass 1 |
| 15. | Drilling |
| 16. | Trip Out |
| 17. | End of "Run 2" |

Further as shown in FIG. 5, the data logs (e.g., logged runs (602)-(612)) may include context information. For instance, the context information may include data log names such as 'Drilling, Run 1' in logged run (602), 'ReamUp, Run 1, Pass 1' in logged run (603), etc., data log IDs such as 'L1D' in logged run (602), 'L2RU' in logged run (603), etc., channel data IDs such as 'Channels: A, B' in logged runs (602)-(607) corresponding to BHA 'Run 1' and 'Channels: A, B, C' in logged runs (608)-(612) corresponding to BHA 'Run 2'. Multi-pass data sources (e.g., data source (521)) may store data logs in separate sections such as a main section and multiple subsections. The main section typically contains all time-indexed data and the depth-indexed data from the 'Drilling' pass while the subsections under a main section typically contain depth-indexed data from other passes, for instance 'ReamUp', 'TripOut', etc.

According to the organization of data in the data source (e.g., data logs of the multi-pass data source(s) (521)), the log processing module (504) (including the response processing engine (506) and dispatcher (512)) may receive and dispatch individual data points or a vector of data points to the field application (541). Examples of individual data points may include a single data channel in a single row of a table formatted data log. Examples of a vector of data points may include an entire row relating to multiple data channels sharing a common index value in a table formatted data log. Data context information (e.g., 'PassNumber', 'RunNumber', and direction parameters) needs to be provided to the field application (541) along with the vector of data points for data interpretation. This vector of data points may be considered a 'Pseudo Data Frame'. A data log (e.g., any of the logged runs (602)-(612)) dispatched in vectors is typically globally ordered by index value, and logically contains related groups having multiple adjacent 'Pseudo Data Frames' that share a common index progressing through consecutive values. To split the related groups out of the vectors, the response processing engine (506) and the dispatcher (512) of the log processing module (504) may be configured to consider that, in general the related groups may not be explicitly identified and data channels may be missing values corresponding to a given index value.

As RT field application (541) requests data from data source(s) (521), a request data description list (RDDL) (622) is generated in the RTDL (501) to describe details of data requested from the field application (541). The 'Channel Refresh Worker' thread (621.2) executed in the RTDL (501) may periodically query the data source(s) (521) to determine whether any new data logs are created in the wellbore or if any new data channels have been added to the data logs already being read. The ADDL (623) is updated accordingly by the 'Channel Refresh Worker' thread (621.2). For instance, ADDL (623), as depicted in FIG. 5, indicates that available data from data channel A may be found in data logs L1D, L2RU, L3RDm L4RU, L5RD, L6TO, L8D, L9RU, L10RD, and L11TO; available data from data channel B, may be found in data logs L1D, L2RU, L3RDm L4RU, L5RD, L6TO, L8D, L9RU, L10RD, and L11TO; and available data from data channel C may be found in data logs L8D, L9RU, L10RD, and L11TO.

In addition, the 'Data Worker' thread (621.1) executed via the response processing engine (506) and the dispatcher (512) may treat drilling and non-drilling passes in two distinct ways as follows:

Switching Log Thread: there is an 'intelligent switching' between the two drilling data logs, L1D and L8D because they share channels A and B, albeit over different index ranges. When the end of data is reached for data log L1D then a 'switch' is made to data log L2D to read its data. The data logs are pre-sorted according to beginning measured depth index. MCQ logic is employed to handle log switching for multiple shared channels (e.g., channels A and B) since channels A and B can potentially switch between logs L1D and L8D at different index values.

Parallel Log Thread: all of the non-drilling logs are queried in parallel, respecting direction.

In addition, the response processing engine (506) may enqueue data vectors into related groups (508.1, 508.2) (based on context information) by adding them into separate dispatch queues (based upon processed context identifiers). The dispatcher (512) may then batch data according to these context-segregated queues while considering maximum size and minimum frequency.

Some RTDL applications may be multi-pass-enabled, and others may not be designed to handle multi-pass data. Therefore, a global attribute (e.g., referred to as Boolean MultiPassEnabled) may be set on an API. By default, this attribute may be set to 'False'. It is expected that an application does not normally change this value during its session, and it would be locked after connection is made to a specific wellbore or section. The value of this attribute may affect how available data is interpreted and queried. As mentioned above, it also affects the context information that is dispatched to the application.

RTDL (501) may provide capabilities for programmatic access to the entire state of the framework (500) including the ability to create the GUI through the API. The framework (500) enforces supported call sequences so that the application (e.g., field application (541)) does not use the framework (500) improperly. Additional capabilities that may be supported by RTDL (501) are described in TABLE 7 below.

TABLE 7

| |
|---|
| Sequential Play Back across multiple logs: |
| RTDL can dispatch MP depth-indexed data in two ways: |
| 1. Play Back perspective: |
| Send the depth-indexed data back to the application sequenced by time, dynamically switching between different logs/passes, so that the data arrives in the order in which it was originally obtained. |
| 2. Parallel perspective: |
| Mark the data with context, but don't try to play it back in time sequence |
| Managing MP for time-indexed logs |
| Source Exposure: The source information is made available through the API, including the ability to see the 'adaptabilities' of the source, i.e. which objects are supported via RTDL. |
| Raw Data: Applications can request well-formed and standard-adhering WITSML for any object using the API. The applications can optionally also get the 'unprocessed' data from sources. This allows applications to use RTDL to obtain data objects from sources, even if RTDL doesn't know how to process them. For instance, if an application needed to get a SideWallCore from a WITSML API source, but RTDL did not have an 'ISideWallCoreData' object, then it would be possible to ask for this object type unprocessed, and to get back the WITMSL. RTDL, optionally, provides the support for setting up the request and parsing it. |

TABLE 7-continued

| |
|---|
| RDDs: RDDs have a dual purpose use as both filters and requested data specifiers. These concepts can be separated so that the way an application filters data is distinct from requesting the data. |
| Multiple Log Handling: RTDL has the capability of processing the same channel from Multiple Logs - some servers publish data into different sibling sections based upon hole size. For instance, a '12.5 inch' section contains log data, but an '11 inch' sibling section is created later that also contains log data. This log channel data logically flows across time and depth between these 2 sibling sections. |
| Global Index: Applications and users have the ability to specify index ranges like 'Starting From, Go Back . . . ' For instance, 'Starting Now, and Going back 30 minutes'. This can be done at a "global" level which applies to all relevant indexed data (both time and depth). |

Figure 6:
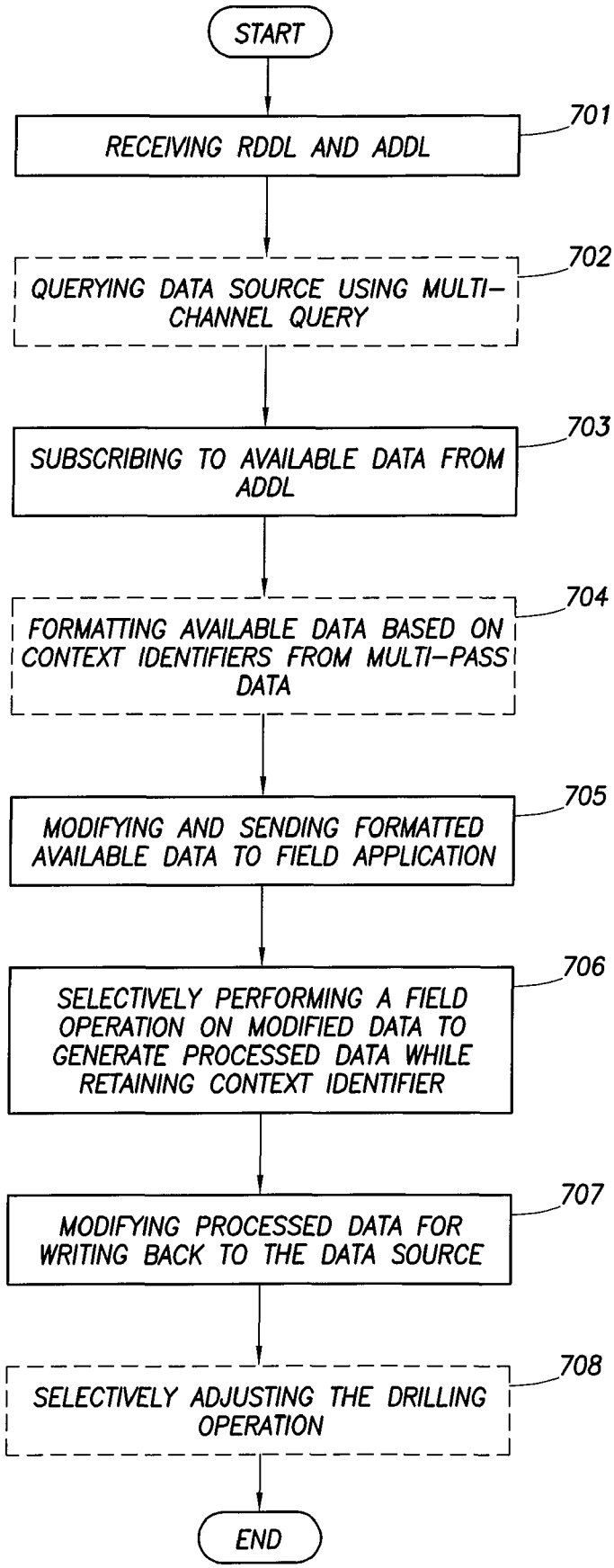
FIG. 6 depicts a flow chart of a method for a real-time data workflow of a drilling operation.

FIG. 6 depicts a flow chart of a method for a real-time data reading workflow of a drilling operation. The drilling operation may be performed, for instance, at a wellsite (400) shown in FIG. 2 of a field. The real-time data workflow may be related to data collected for the field (100) of FIG. 1.

Initially, data may be requested by a field software application using a requested data description list (RDDL) that is received by Real-Time Data Link (RTDL) (block 701). The RTDL may query a data source based on the RDDL combining multiple data channels in a single query (block 702). Responsive to the query, the RTDL may receive an available data description list (ADDL) from the data source (block 701).

A user of the field software application may then map the RDDL and ADDL to select data (not shown). Accordingly, the RTDL may subscribe to the mapped available data from the ADDL (block 703). The RTDL may modify the data format and communication protocol according to the data source specifics.

Data received from the data source may be multi-pass data tagged with context information, such as context marker or context identifier. The RTDL may format the received available data based on the context identifiers (block 704) for sending to the field application (block 705). The RTDL may modify the data format and communication protocol according to the field application requirement. The field application may optionally process the formatted data in performing a field operation and generate processed data while retaining the context information (block 706). The processed data may optionally be written back to the data source for updating or storage (block 707). Finally, the drilling operation may be optionally adjusted based on processed data (block 708).

The Real-Time Data Link (RTDL) may be implemented on virtually any type of computer regardless of the platform being used. For instance, the RTDL may be implemented on a computer system that includes a processor, associated memory, a storage device, and numerous other elements and functionalities typical of today's computers. The computer system may also include input means, such as a keyboard and a mouse, and output means, such as a monitor.

The computer system may be connected to a local area network (LAN) or a wide area network (e.g., the Internet) via a network interface connection. Those skilled in the art will appreciate that these input and output means may take other forms.

Further, those skilled in the art will appreciate that one or more elements of the aforementioned computer system may be located at a remote location and connected to the other elements over a network. Further, real-time, bi-directional data management may be implemented on a distributed system having a plurality of nodes, where each portion of real-time, bi-directional data management may be located on a different node within the distributed system. In one example, the node corresponds to a computer system. Alternatively, the node may correspond to a processor with associated physical memory. The node may alternatively correspond to a processor with shared memory and resources. Further, software instructions to perform embodiments of real-time, bi-directional data management may be stored on a computer readable medium such as a compact disc (CD), a diskette, a tape, a file, or any other computer readable storage device.

The method is depicted in a specific order. However, it will be appreciated that portions of the method may be performed simultaneously or in a different order or sequence. Further, throughout the method, the field data may be displayed, the canvases may provide a variety of displays for the various data collected and/or generated, and he display may have user inputs that permit users to tailor the field data collection, processing and display.

It will be understood from the foregoing description that various modifications and changes may be made in the embodiments of real-time, bi-directional data management without departing from its true spirit. For instance, the method may be performed in a different sequence, and the components provided may be integrated or separate.

This description is intended for purposes of illustration only and should not be construed in a limiting sense. The scope of real-time, bi-directional data management should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A method for obtaining field data using real-time, bi-directional data management, comprising:

receiving a requested data description list from a field application associated with a drilling system;

receiving an available data description list from a data source;

subscribing, in response to receiving the available data description list, to available data by mapping the available data description list to the requested data description list, the available data having a first data format and a first communication protocol associated with the data source and comprising a first context identifier assigned by the data source for identifying a portion of the available data, the available data including at least one data log tagged with the first context identifier;

modifying the available data to generate first modified data having a second data format and a second communication protocol for sending to the field application, the first modified data comprising the first context identifier for identifying a portion of the first modified data;

sending, using the second communication protocol, the first modified data to the field application, wherein the field application selectively performs a field operation based on the first modified data to generate processed data, the processed data comprising the first context identifier, the first context identifier identifying a portion of the processed data corresponding to the at least one data log;

receiving, using the second communication protocol, the processed data from the field application;

modifying, in response to receiving the processed data from the field application, the processed data to generate second modified data having the first data format and the first communication protocol;

sending, using the first communication protocol, the second modified data to the data source; and updating, by the data source, the available data to generate updated available data based on the second modified data, wherein the field operation is adjusted using the processed data.

2. The method of claim 1, wherein the first context identifier is used to identify at least a portion of the updated available data.

3. The method of claim 1, wherein the requested data description list pertains to a plurality of data channels associated with the data source, wherein the available data description list pertains to at least one data channel of the plurality of data channels, and wherein the available data is subscribed from the at least one data channel by mapping the available data description list to the requested data description list.

4. The method of claim 3, wherein the available data description list pertains to a plurality of drilling tool runs, a drilling tool run of the plurality of drilling tool runs having one or more drilling tool passes, a drilling tool pass of the one or more drilling tool passes generating a first data log pertaining to the at least one data channel, the first data log being the portion of the available data and being tagged with the first context identifier, wherein the available data further comprises a second data log related to the plurality of drilling tool runs, the second data log being tagged with a second context identifier, and wherein the available data is modified to the second data format based on the first context identifier and the second context identifier.

5. The method of claim 4, wherein the one or more drilling tool passes comprises a drilling pass, a ream-up pass, a ream-down pass, and a trip-out pass.

6. The method of claim 4, wherein the first context identifier represents a corresponding drilling tool run.

7. The method of claim 1, wherein the data source comprises at least one selected from a group consisting of a database system, a file system, a web service, a peer application, a multi-pass source, and a subscription service, and wherein the field application comprises at least one selected from a group consisting of an acquisition system, an engineering analysis, a real-time surveillance, and a data broker service.

8. A system for obtaining field data using real-time, bi-directional data management, comprising:

a computer processor;

an application programming interface executing on the computer processor and configured to:

receive a requested data description list from a field application associated with a drilling system, the requested data description list pertaining to a first data channel associated with a data source; and subscribe, based on an available data description list received from the data source, to available data from the first data channel, the available data comprising a first data log and a second data log related to a plurality of drilling tool runs, the first data log being tagged with a first context identifier and the second data log being tagged with a second context identifier, the available data having a first data format and a first communication protocol;

send, using a second communication protocol, first modified data to the field application, wherein the field application selectively performs a field operation based on the first modified data to generate processed data, the processed data comprising the first context identifier, the first context identifier identifying a portion of the processed data corresponding to the first data log;

receive, using the second communication protocol, the processed data from the field application; and send, using the first communication protocol, second modified data to the data source;

wherein the data source updates the available data to generate updated available data based on the second modified data, wherein the field operation is adjusted using the processed data; and data adapter software operatively connected to the application programming interface and executing on the computer processor, wherein the data adapter software is configured to:

receive the available data description list from the data source, the available data description list pertaining to a plurality of drilling tool runs, a drilling tool run of the plurality of drilling tool runs having one or more drilling tool passes, a drilling tool pass of the one or more drilling tool passes generating the first data log, the first data log pertaining to the first data channel;

format the available data based on the first context identifier and the second context identifier to generate the first modified data, the first modified data having a second data format and the second communication protocol; and format the processed data to generate the second modified data, the second modified data having the first data format and the first communication protocol.

9. The system of claim 8, wherein the first context identifier is used to identify at least a portion of the updated available data.

10. The system of claim 8, wherein the requested data description list further pertains to a second data channel associated with the data source, wherein the first data log and the second data log further pertain to the second data channel, and wherein the available data is further subscribed from the second data channel by mapping the first data log and the second data log in the available data description list to the second data channel in the requested data description list.

11. The system of claim 8, wherein the data source comprises at least one selected from a group consisting of a database system, a file system, a web service, a peer application, a multi-pass source, and a subscription service, and wherein the field application comprises at least one selected from a group consisting of an acquisition system, an engineering analysis, a real-time surveillance, and a data broker service.

12. The system of claim 8, wherein the plurality of drilling tool passes comprises a drilling pass, a ream-up pass, a ream-down pass, and a trip-out pass.

13. The system of claim 8, wherein the first context identifier represents a corresponding drilling tool run.

14. A non-transitory computer readable medium, embodying instructions executable by a computer to perform method steps for obtaining field data using real-time, bi-directional data management, the instructions comprising functionality to:

receive a requested data description list from a field application associated with a drilling system, the requested data description list pertaining to a plurality of data channels associated with a data source;

query the data source based on the requested data description list using a multi-channel query, the multi-channel query pertaining to the plurality of data channels;

receive an available data description list from the data source, the available data description list pertaining to at least one data channel of the plurality of data channels;

subscribe, based on the available data description list, to available data from the at least one data channel, the available data having a first data format and a first communication protocol and comprising a first context identifier assigned by the data source for identifying a portion of the available data, the available data including at least one data log tagged with the first context identifier;

modify the available data to generate first modified data having a second data format and a second communication protocol for sending to the field application;

send, using the second communication protocol, first modified data to the field application, where the field application selectively performs a field operation based on the first modified data to generate processed data, the processed data comprising the first context identifier, the first context identifier identifying a portion of the processed data corresponding to the at least one data log;

receive, using the second communication protocol, the processed data from the field application;

modify, in response to receiving the processed data from the field application, the processed data to generate second modified data having the first data format and the first communication protocol;

send, using the first communication protocol, the second modified data to the data source; and update, by the data source, the available data to generate updated available data based on the second modified data, wherein the field operation is adjusted using the processed data.

15. The non-transitory computer-readable medium of claim 14, wherein the first context identifier is used to identify at least a portion of the updated available data.

16. The non-transitory computer readable medium of claim 14, wherein the data source comprises at least one selected from a group consisting of a database system, a file system, a web service, a peer application, a multi-pass source, and a subscription service, and wherein the field application comprises at least one selected from a group consisting of an acquisition system, an engineering analysis, a real-time surveillance, and a data broker service.

17. The non-transitory computer readable medium of claim 14, wherein the available data description list pertains to a plurality of drilling tool runs, a drilling tool run of the plurality of drilling tool runs having one or more drilling tool passes, a drilling tool pass of the one or more drilling tool passes generating a first data log pertaining to the at least one data channel, the first data log being a portion of the available data and being tagged with the first context identifier, wherein the available data further comprises a second data log related to the plurality of drilling tool runs, the second data log being tagged with a second context identifier, and wherein the available data is modified to the second data format based on the first context identifier and the second context identifier.

18. The non-transitory computer readable medium of claim 17, wherein the plurality of drilling tool passes comprises a drilling pass, a ream-up pass, a ream-down pass, and a trip-out pass.

19. The non-transitory computer readable medium of claim 17, wherein the first context identifier represents a corresponding drilling tool run.

* * * * *